United States Patent [19]

Kapland et al.

[11] Patent Number: 4,641,449

[45] Date of Patent: Feb. 10, 1987

[54] ANTI-LOCK UP MECHANISM FOR REVOLVERS

[75] Inventors: Mitchell A. Kapland, Annapolis, Md.; Kiyoshi Norikane, Park Forest, Ill.; Jack W. London, Austin, Tex.

[73] Assignee: Trident Engineering, Inc., Annapolis, Md.

[21] Appl. No.: 672,924

[22] Filed: Nov. 19, 1984

[51] Int. Cl.[4] ..... F41C 1/00; F41C 17/08

[52] U.S. Cl. ..... 42/65; 42/66

[58] Field of Search ..... 42/65, 66, 67

[56] References Cited

U.S. PATENT DOCUMENTS

| | | | |
|---|---|---|---|
| 193,367 | 7/1877 | Forehand et al. | 42/65 |
| 313,048 | 3/1885 | Bliss | 42/67 |
| 4,218,839 | 8/1980 | Brouthers | 42/65 |

FOREIGN PATENT DOCUMENTS

| | | | |
|---|---|---|---|
| 186131 | 9/1922 | United Kingdom | 42/67 |

*Primary Examiner*—Deborah L. Kyle
*Assistant Examiner*—Michael Carone
*Attorney, Agent, or Firm*—Cushman, Darby & Cushman

[57] ABSTRACT

An anti-lock up improvement for a conventional revolver which comprises a cam follower lever cooperating with cam surfaces on the hand for insuring that during a manually controlled movement of the trigger through a second segment of its return stroke, following a manual hammer movement back into its battery position, the hand end will move into a position to engage the next ratchet tooth after the trigger has been engaged with the cylinder lock, so that the trigger can be manually moved into its rearward position from any position within the manually controlled second segment of the return stroke of the trigger, thus preventing the trigger from being locked against such movement as would be the case when the hand moves into a position to engage the next ratchet tooth before the trigger has been engaged with the cylinder lock, and the manual movement of the trigger toward its rearward position is commenced after the hand end has been moved into a position to engage the next ratchet tooth and before the trigger has engaged the cylinder lock.

6 Claims, 17 Drawing Figures

Fig. 1.
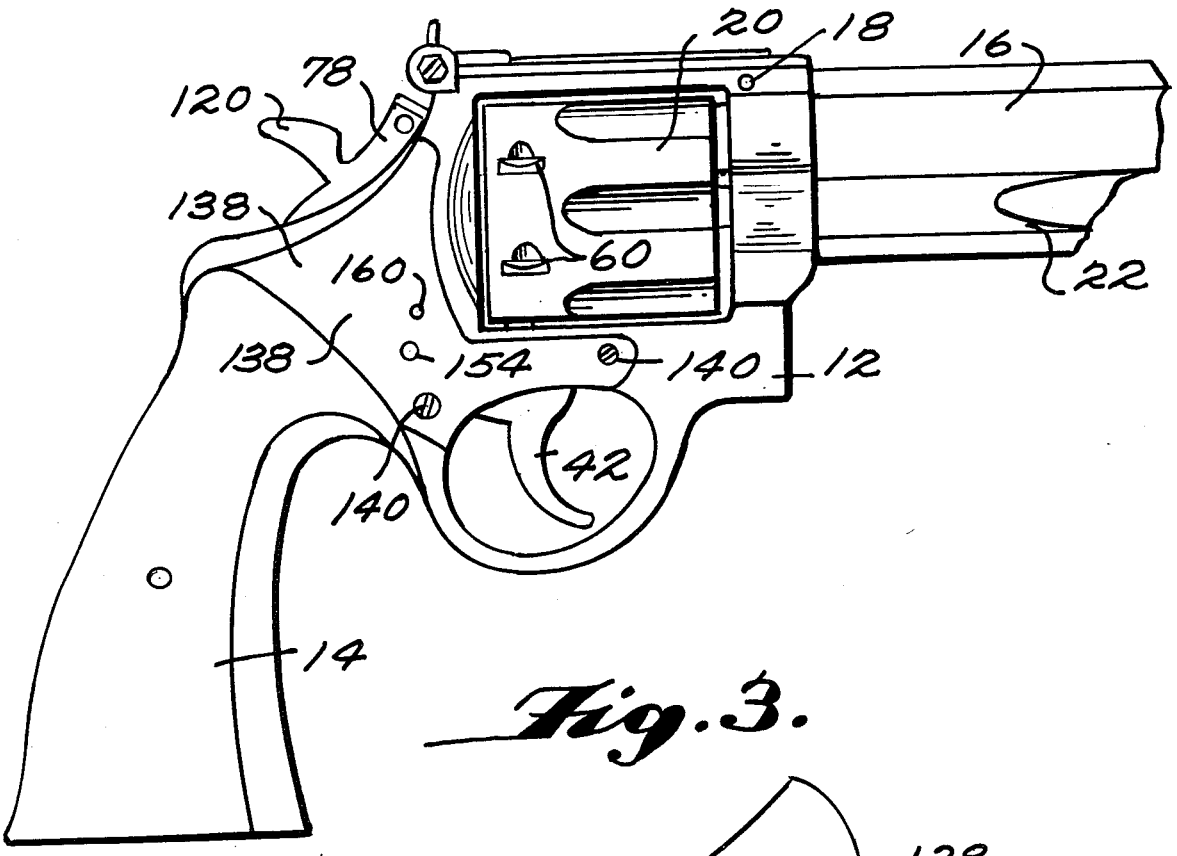
Fig. 3.
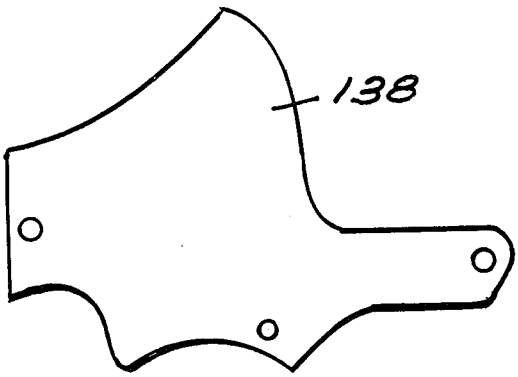
Fig. 5.
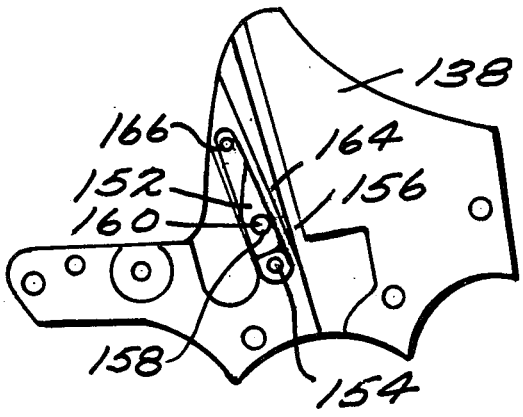
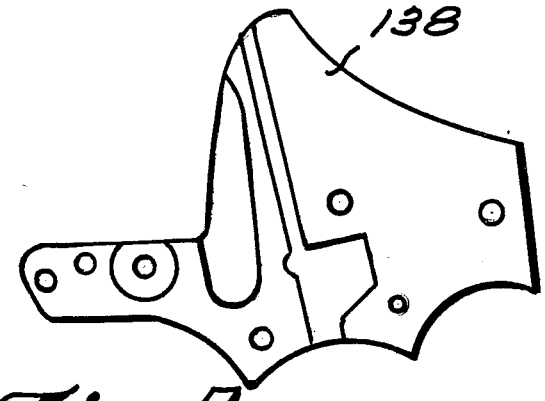
Fig. 4.

ANTI-LOCK UP MECHANISM FOR REVOLVERS

This invention relates to hand guns and, more particularly, hand guns of the revolver or six-shooter type.

The type of hand gun herein contemplated is made by several manufacturers and constitutes standard equipment used by most policemen. The construction of such hand guns is fairly conventional and the units manufactured by various manufacturers generally embody the same component parts operating generally in the same fashion. Briefly, the usual revolver type hand gun includes a frame provided with stocks at one end for convenient manual gripping and a barrel extending from the other end. Mounted for rotation rearwardly of the barrel is a cylinder containing six cartridge receiving chambers. An extractor is usually associated with the rearward face of the cylinder and the extractor is provided with a series of indexing ratchet teeth. The exterior periphery of the cylinder is provided with six annularly spaced locking notches or recesses within which a cylinder stop is adapted to enter for purposes of preventing rotation of the cylinder in the feeding direction, as well as the opposite direction. The cylinder stop is mounted on the frame for movement between its locking position toward which it is spring pressed and a cylinder releasing position which is out of engagement with a cylinder recess. A hammer is pivotally mounted on the frame at a position rearwardly of the cylinder for movement between a cocked position and a firing position toward which it is spring urged. The hammer includes a rearwardly extending spur which is adapted to be engaged by the thumb of the user to permit the hammer to be manually moved between a barrel position adjacent the firing position and the cocking position.

A trigger is pivotally mounted on the frame in a position below the cylinder and forwardly of the stocks for movement between forward and rearward positions. The trigger has (1) an engagable and disengagable connection with the cylinder stop, (2) a pivotal connection with a hand which has an end guided to engage the indexing ratchet teeth of the cylinder and (3) an engagable and releasable connection with the hammer. These connections are such that when the trigger is moved from its forward position through a large cocking segment of its firing stroke toward its rearward position, (1) the cylinder stop is engagingly moved into its cylinder releasing position and then disengaged for spring urged movement into its cylinder locking position in response to the completion of the next indexed movement of the cylinder, (2) the hand is moved to engage the end thereof with a ratchet tooth after the cylinder stop has been moved into its cylinder releasing position so as to effect movement of the cylinder through its next indexing movement, and (3) the hammer is moved into its cocked position. When the trigger is subsequently moved through a relatively small firing segment of its firing stroke, the hammer is released for spring urged movement from its cocked position into its firing position to discharge a cartridge in the cartridge chamber aligned with the barrel. After firing, the trigger is manually released for manually controlled spring biased movement from its rearward position through a return stroke back into its forward position. During this movement the following three functions occur (1) the hand is moved into a position to engage the end thereof with the next ratchet tooth, (2) the trigger is engaged with the cylinder stop while the latter is in its locked position and (3) the trigger is engaged with the hammer.

When the trigger is moved from its forward position to its rearward position through a firing stroke, which includes a first relatively large cocking segment during which the hammer is cocked and a second relatively small firing segment, during which the hammer is released, the procedure is referred to as a double action firing. The typical gun is capable of being fired after the hammer has been moved from its normal barrel position into its cocked position by thumb engagement with the spur. After the hammer has been cocked, a firing can be accomplished simply by moving the trigger through the relatively small firing segment of its firing stroke. This procedure is referred to as a single action firing.

In normal police work where a policeman approaches a dangerous situation where the gun may be instantly needed, it is common practice for the policeman to draw the gun and move the hammer into its cocked position so that the gun is prepared for initial single action firing. When the imminent danger has passed, the usual procedure is for the policeman to manually release the hammer from its cocked position and to move it under manual control back into its barrel position. During this movement it is natural for the policeman to have his finger on the trigger and to retain it in a position at the end of the cocking segment until such time as the hammer has been moved back into its barrel position. Thereafter, the policeman releases the trigger so that the trigger can return to its forward position rendering the gun suitable for repeat double action firing.

Policemen are trained to release the trigger and allow it to return to its forward position but only after the gun has been fired so that repeated double action firing can be accomplished. With the above in mind, a scenario which has been reported in the newspapers to have existed involved a situation in which a policeman in a squad car had received a radio report that a rape was occurring in an automobile parked in a given location. The policeman immediately drove to the spot, disembarked from his car with his hand gun drawn and cocked for single action firing. As he started to approach the suspect car, he noticed a woman disembarking and underwent the procedure of manually moving the hammer back into its barrel position. As the policeman was releasing the trigger, he noticed a hand and a gun appearing from the opposite side of the car, and at that instant he turned to fire. Instead of firing the gun, the police officer took two bullets from the gun which was aimed at him.

The officer lived long enough to explain that the reason he had been unable to fire upon his assailant was that he was pulling the trigger of his gun, but the trigger was simply locked up and would not move. This trigger lock up was determined to be caused by the timing of two of the three functions which must occur when the trigger is released after the hammer has been returned to its barrel position. As previously indicated, there are three functions which should occur, two of which include (1) the movement of the hand into a position to engage the end thereof with the next ratchet tooth, and (2) the engagement of the trigger with the cylinder stop while the latter is in its locked position. In all conventional revolver type hand guns of the type herein contemplated, hand function (1) occurs before the cylinder stop function (2) so that if the forward movement of the trigger is stopped after function (1) has occurred but before function (2) has occurred and the movement of the trigger is reversed to a rearward movement, lock up occurs because the hand which is pivoted to the trigger has its opposite end engaged with a ratchet tooth which cannot move because the cylinder stop is in its locked position preventing movement of the cylinder and ratchet tooth and cannot be moved out of such locked position because the trigger has not yet engaged it. So long as the user attempts to apply rearward pressure to the trigger, nothing will happen. Of course, if the trigger is released, normal double action firing can resume. But the locking circumstance happens so infrequently that gun users are not trained to effect the manual release, especially not quickly enough to accomplish subsequent firing under emergency conditions. The instinct is to get the trigger into the position from which it is normally released, rather than to release it from an abnormal position. Thus, there is presented a dangerous situation which can arise in unusual situations such as noted above.

The object of the present invention is to provide an improvement for a conventional revolver type hand gun which will insure that the hand function (1) will occur after the cylinder stop function (2) so that the trigger can be manually moved into its rearward position from any position within the manually controlled second segment of the return stroke of the trigger, thus preventing the trigger from being locked against such movement as would be the case when function (1) occurs before function (2) and the manual movement of the trigger towards its rearward position is commenced after function (1) has been accomplished but before function (2) has been accomplished.

Preferably, the means for insuring lock up prevention as noted above comprises means for causing the end of the hand to move from its ending position along a different ratchet tooth avoiding path into its starting position during the second segment of the return stroke of the trigger so that the hand end will follow the different ratchet tooth avoiding path when the trigger is manually moved into its rearward position from any position with the manually controlled second segment of the return stroke of the trigger before function (2) is performed.

Preferably, the above path altering arrangement is accomplished by means of a cam track in the hand and a cam track follower mounted on the end of a lever mounted alongside the hand.

Another object of the present invention is the provision of a gun having an improvement of the type described which is simple in construction, effective in operation and economical to manufacture.

These and other objects of the present invention will become more apparent during the course of the following detailed description and appended claims.

The invention may be best understood with reference to the accompanying drawings, wherein an illustrative embodiment is shown.

In the drawings:

FIG. 1 is a side elevational view of a revolver type hand gun embodying the improvements constructed in accordance with the principles of the present invention;

FIG. 3 is a side elevational view of the removable side plate viewing the exterior surface thereof;

FIG. 4 is a side elevational view of the side plate viewing the interior surface thereof;

FIG. 5 is a view similar to FIG. 4 illustrating the modifications of the side plate shown in FIG. 4 made in accordance with the principles of the present invention;

Figure 2:
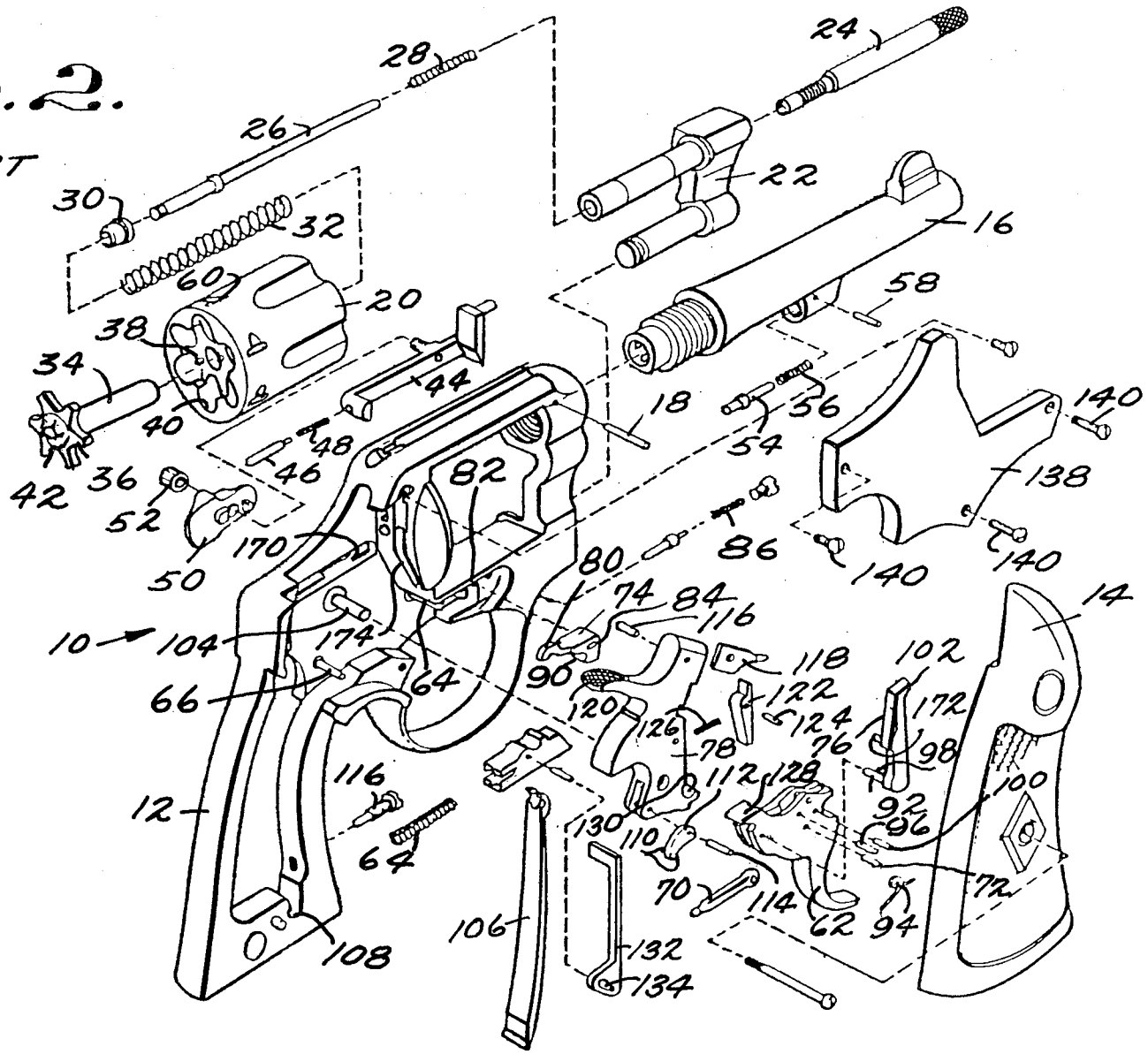
Fig. 2. PRIOR ART
FIG. 2 is an exploded perspective view of a conventional Smith and Wesson revolver.

Referring now more particularly to FIG. 2 of the drawings, there is shown in exploded perspective view the component parts of a conventional Smith and Wesson double action revolver type hand gun, which is generally indicated by the reference numeral 10. The gun 10 includes a frame 12 having one end shaped to receive on opposite sides thereof opposed stocks 14 which provide the hand grip portion of the gun. Extending forwardly from the frame 12 is a barrel 16. As shown, the barrel is threaded into the forward upper end of the frame 12 and secured in proper position by a pin 18. The frame includes an opening positioned rearwardly and below the rearward end of the barrel for receiving a cylinder 20. The cylinder is mounted for pivotal swinging movement between an outboard loading position and an operative position disposed within the frame opening. This mounting is accomplished by a yoke assembly which includes a yoke 22, an extractor rod 24, a center pin 26, a center pin spring 28, an exterior rod collar 30, an extractor spring 32 and extractor 34.

The extractor 34 has a six-pointed starlike extractor portion 36 formed on its rearward end which normally seats within a commonly shaped recess 38 formed in the rearward end of the cylinder 20. The cylinder 20 also is formed with a series of six cartridge receiving chambers 40. The rearward radially inward end of each chamber 40 communicates with an adjacent portion of the recess 38. Formed on the extractor 34 rearwardly of the star-shaped extractor portion is a series of six annularly spaced fixed ratchet teeth 42.

The cylinder 20 is releasably locked into its operative position within the frame opening by a bolt assembly which includes a bolt 44, a bolt plunger 46, a bolt plunger spring 48, a thumb piece 50, a thumb piece nut 52, a locking bolt 54, a locking bolt spring 56 and a locking bolt pin 58.

The mounting of the cylinder 20 by the yoke assembly not only serves to effect movement of the cylinder 20 between its loading and operating positions, but also to rotatably mount the cylinder about its axis so that it can be moved by engagement of successive ratchet teeth 42 into successive operating positions in which successive chambers are brought into alignment with the barrel 16. Cylinder 20 has formed in the rearward exterior periphery thereof a series of locking recesses 60 which are positioned so as to correspond with the six operating positions of rotation of the cylinder.

The frame 12 also provides an opening forwardly of the hand grip stocks 14 and below the cylinder 20 within which a trigger 62 is mounted for engagement by the finger of a user gripping the hand grip. The trigger is pivoted on a pin 64 which is fixed to the portion of the frame extending between the stocks 14 and cylinder 20. This portion of the frame is opened at the right side and is appropriately recessed to receive the trigger 62. The trigger is resiliently biased into a forward position by a trigger spring 64 which acts against a pin 66 and a rebound slide 68. The rearward end of the rebound slide is bifurcated to receive the pin 66 therein and is bored forwardly of the bifurcation to receive the spring 64. The forward end of the slide is also recessed to receive the rear end of a trigger lever 70, the forward end of which is pivoted to the trigger 62, as by a pivot pin 72. The trigger 62 has (1) an engagable and disengagable connection with a cylinder stop 74 adapted to cooperate with the cylinder stop recesses 60, (2) a pivotal connection with a hand 76, which is adapted to engage successive ratchet teeth 42 and (3) an engabable and releasable connection with a hammer 78.

The cylinder stop 74 includes a rearward recess engaging or locking portion 80 which is shaped to engage within a cylinder stop recess 60 so as to lock the cylinder 20 against movement when the cylinder is in an indexed operating position. The cylinder stop 74 is mounted for movement from its cylinder locking position into a cylinder releasing position wherein the locking portion 80 is disposed out of engagement with the cylinder recess 60. As shown, the mounting of the cylinder stop 74 is accomplished by a pin 82 fixed to the frame 12 forwardly of the trigger 62 and a horizontally elongated slot 84 in the cylinder stop 74 which receives the pin 82 therethrough. A cylinder stop spring 86 is mounted with its forward end in a blind bore formed in the frame 12 and its rearward end within a blind bore formed in the lower forward portion of the cylinder stop so as to resiliently bias the cylinder stop 74 into its cylinder locking position wherein the portion 80 is disposed within a cylinder recess 60 and the mounting pin 82 is disposed in the forward portion of the horizontally elongated slot 84. The engagable and disengagable connection between the trigger and the cylinder stop 84 is provided by a forwardly extending latch portion 88 formed on the upper forward portion of the trigger 62 and a cooperating latch portion 90 extending rearwardly from the lower forward end of the cylinder stop 74 below the slot 84.

The pivotal connection between the hand 76 and the trigger 62 is preferably provided by a pivot pin 92 which is fixed to one end of the hand 76 and extends through a rearwardly extending portion of the trigger 62. A hairpin spring 94, having a central looped portion fixed on a pin 96 carried by the trigger 62, serves to resiliently bias the hand 76 in a clockwise direction, as viewed in FIG. 2, with respect to the trigger 62. One end of the spring 94 bears on a pin 98 fixed to the end in adjacent parallel relation to the pivot pin 92. Pin 98 extends within corresponding arcuate openings within the trigger 62. The opposite end of the spring 94 is connected with a pin 100 fixed to the trigger 62 adjacent the pin 96. It will be noted that the hand 76 includes a forwardly projecting end 102 which is shaped to engage successive ratchet teeth 42.

The hammer 78 is pivotally mounted on the frame 12, as by a pivot pin 104, for movement between a forward firing position and a rearward cocked position. The hammer 78 is spring biased to move toward its firing position by a leaf spring 106, the lower end of which seats within a recess 108 formed in the frame and the upper end of which is bifurcated to engage the opposite ends of a pin 110 fixed to the end of a stirrup 112. The forward end of the stirrup 112 is pivoted to a lower rearward portion of the hammer 78, as by a pivot pin 114. A strain screw 116 is threaded into frame 12 at a position above the recess 108 sufficient to engage the forward surface of the leaf spring 106 so as to insure that the upper end of the leaf spring will be biased rearwardly. By virtue of the connection of the hammer 78 with the stirrup 112 connected to spring 106, the latter serves to bias the hammer 78 in a clockwise direction, as viewed in FIG. 2.

Mounted on the upper forward portion of the hammer 78 for limited pivotal movement, as by a pin 116, is a hammer nose 118 which is adapted to strike a cartridge mounted in a cylinder chamber 40 aligned with the barrel when the hammer is moved forwardly into its firing position so as to discharge the cartridge. The hammer 78 also includes a thumb engaging spur 120 which extends from the upper rearward position thereof in a position to be engaged by the thumb of a user gripping the hand grip so as to allow the user to manually move the hammer into its cocked position and to permit manually controlled movement of the hammer from its cocked position into a normal barrel position adjacent the firing position.

The engagable and releasable connection between the trigger 62 and hammer 78 is provided in part by a sear 122 pivoted to the forward central portion of the hammer 78, as by a pivot pin 124. A spring 126 serves to resiliently bias the sear 122 in a counter-clockwise direction, as viewed in FIG. 2 into an actuating position wherein the lower end of the sear is disposed above a rearwardly projecting sear-engaging latching portion 128 on the trigger 62 when the latter is disposed in its forward position. The sear engaging portion 128 also cooperates with a releasing portion 130 extending forwardly from the lower portion of the hammer 78 in a position below the sear-engaging portion 120 of the trigger when the latter is in its forward position.

A hammer block 132 is mounted in a position to retain the hammer in its barrel position when the trigger is in its forward position. The hammer block 132 has a connection with the rebound slide 68 such as to move the hammer block 132 out of its hammer blocking position when the trigger has been moved against the action of the return spring 64 from its forward position into a rearward position through a firing stroke. As shown, the hammer block 132 includes an angularly extending slot 134 which receives a pin 136 fixedly carried by the upper central portion of the slide 68. The hammer block 132 is guided in its movement by the surface configuration of the interior of a side plate 138 which is fixed to the frame 12 as, by bolts 140, in a position to close the open recessed side thereof.

Figure 12:
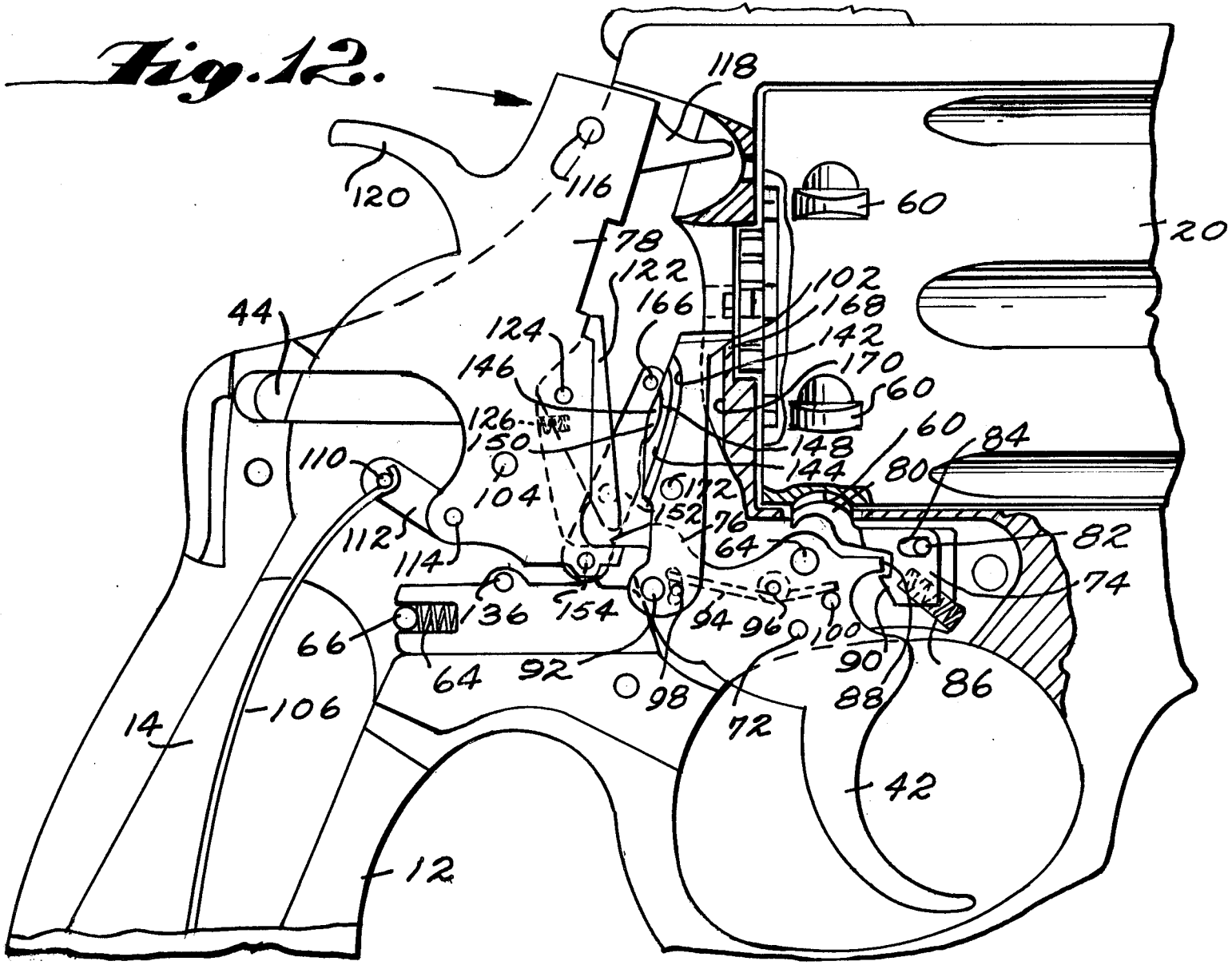
FIG. 12 is a fragmentary side elevational view of the hand gun embodying the improvements of the present invention with the stock, side plate, and hammer block removed for purposes of clearer illustration, the lever of the present invention being shown in phantom lines, the parts being shown in the position they assume prior to a double action firing.

The conventional gun 10, as depicted in FIG. 2, is capable of both double action and single action firing. Double action firing is accomplished by moving the trigger 62 from its forward position (see for example FIG. 12) into its rearward position through a rearward firing stroke. A large cocking segment of the firing stroke serves to move the hammer 78 into a cocked position and to rotate the cylinder 20 into its next operating position. The last relatively small firing segment of the firing stroke of the trigger serves to accomplish the release of the hammer from its cocked position into its firing position under the bias of spring 106.

Figure 13:
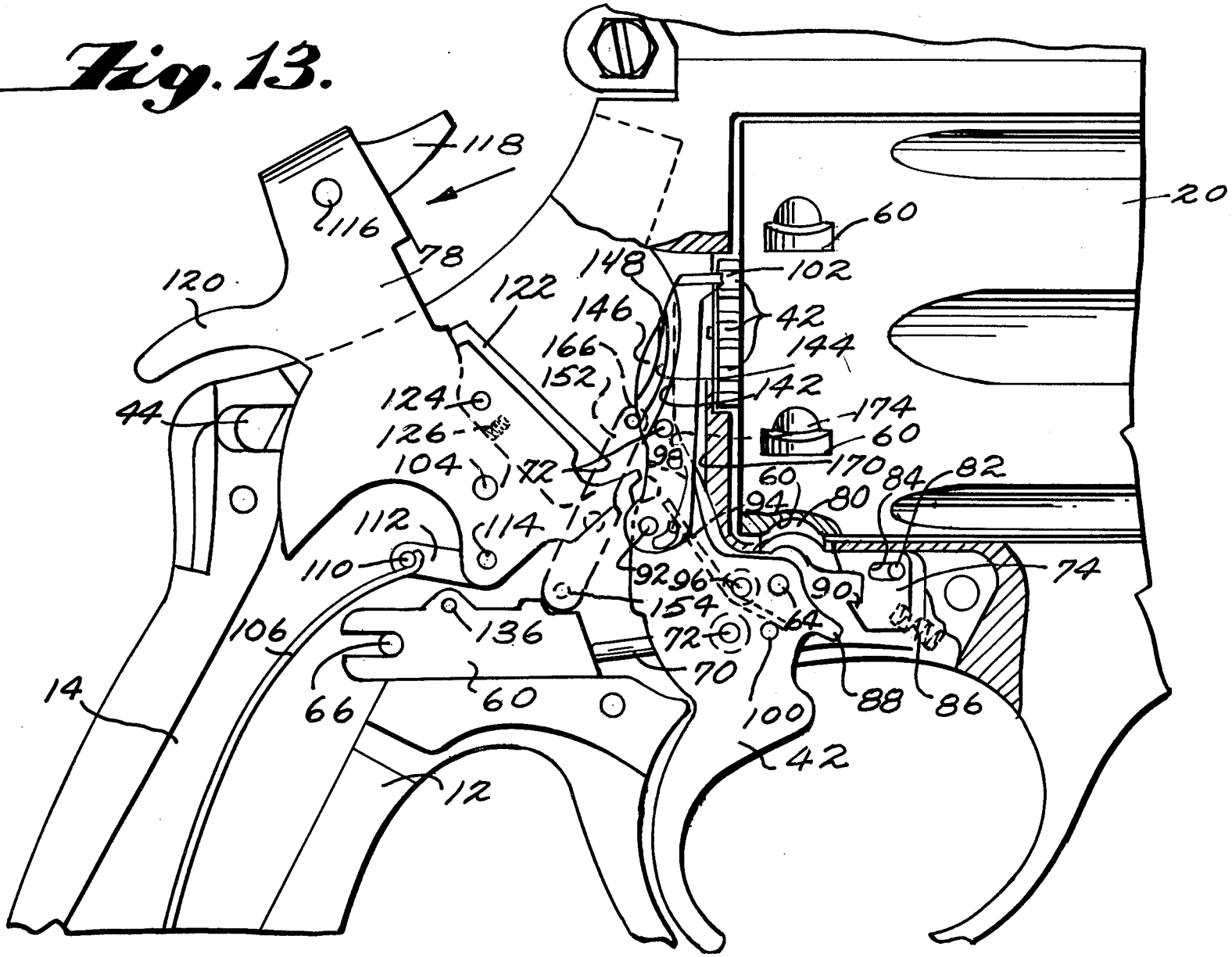
FIG. 13 is a view similar to FIG. 12 showing the parts in the positionthey assume prior to a single action firing.

Single action firing is accomplished when the hammer is initially moved into its cocked position by the engagement of the thumb of the user with the hammer spur 120. This movement also serves to move the trigger 62 through the cocking segment of its firing stroke by virtue of the engagement of the releasing portion 130 of the hammer with the sear-engaging portion 128 of the trigger. The interengagement of the sear-engaging portion 128 of the trigger with the releasing portion 130 of the hammer serves to retain the hammer 78 in its cocked position and the trigger in a position at the end of the cocking segment of its firing stroke and the beginning of the firing segment thereof. When the gun is in this condition (see for example FIG. 13), the user can effect single action firing by simply moving the trigger rearwardly through the relatively small firing segment of its firing stroke.

It will also be noted that by engaging the hammer spur 120 simultaneously with the trigger 62 when the gun is in its cocked position as aforesaid, the user can effect manually controlled movement of the hammer 78 from its cocked position back into its barrel position. Normally, during this movement the user will shortly thereafter manually control the movement of the trigger 62 in a forward direction through a second segment of its return stroke which corresponds with the cocking segment of its firing stroke.

It will be noted that in order to accomplish the indexing movement of the cylinder 20 during the cocking segment of the firing stroke of the trigger, the cylinder stop 74 must be initially moved from its cylinder locking position into its cylinder releasing position by virtue of the engagement of the trigger therewith through latch portions 88 and 90. As soon as the cylinder stop portion 80 has been moved out of engagement with its associated cylinder recess 60, the hand end 102 must be moved into a position to engage with the next ratchet tooth 42 so that an initial turning movement of the cylinder takes place before the trigger 62 is disengaged from the cylinder stop 74 so that when this disengagement occurs, the stop portion 80 will be biased to move into its cylinder locking position but will not actually move therein until the indexing movement has been completed and the next cylinder stop recess 60 moves into registry with the cylinder stop portion 80.

The essential timing of the movement of the cylinder stop 74 and hand 76 by the trigger 62 during the cocking segment of its firing stroke in the conventional hand gun depicted in FIG. 2 dictates the sequence in which the hand end 102 is brought into engagement with the next ratchet tooth 42 and the trigger 62 is engaged with the cylinder stop during the movement of the trigger through the second large segment of its return stroke. This sequence is that the hand end 102 must be engaged with the next ratchet tooth before the trigger is engaged with the cylinder tooth. This sequence establishes the possibility that if the forward movement of the trigger 62 is stopped and reversed to a rearward movement at a point after the hand end 102 has moved into a position to engage the next ratchet tooth 42 but before the trigger 62 has engaged the cylinder stop 74, such rearward movement of the trigger 62 will be prevented by virtue of the engagement of the hand end 102 with a ratchet tooth 42 fixed to a cylinder 20 which cannot move by virtue of the engagement of the cylinder stop 74 being disposed in its locking position.

The improvement of the present invention is provided for the purpose of preventing such a lock out. In accordance with the principles of the present invention, lock up is prevented by insuring that the movement of the hand end 102 into a position to engage the next ratchet tooth 42 will not occur until after the trigger 62 has been engaged by the cylinder stop 74. By insuring this sequence of functions, the user is always able to manually move the trigger into its rearward position from any position within the manually controlled second segment of the return stroke of the trigger. While this functional sequence does not insure that such rearward movement will result in movement of the hammer into its firing position to detonate a live cartridge, it does prevent the trigger from being locked into an intermediate position against rearward movement. Thus, under emergency conditions, the user will not be presented with a situation in which his instinct is to continue to try to move the trigger into its rearward position rather than to release it from an abnormal forward position. Instead, the trigger will always be instantly movable into its rearward position from which it is instinctive to the user to release the trigger for repeated double action firing.

Preferably, the improved functional sequence is provided by causing the end 102 of the hand 76 to move from its ending position into its starting position along a ratchet tooth avoiding path different from the path that the hand end follows when moved from its starting position into its ending position. The arrangement is such that the hand end 102 will follow the different ratchet tooth avoiding path when the trigger 62 is manually moved into its rearward position from any position within the manually controlled second segment of the return stroke of the trigger before the hand end 102 is moved into a position to engage with the next ratchet tooth 42.

In accordance with the principles of the present invention, the above functions are achieved by a simple structural modification in the configuration of the hand 76 and by the addition of one simple component. The functions are accomplished without materially effecting in any way the mode of operation of the gun and its feel to the user.

Figure 10:
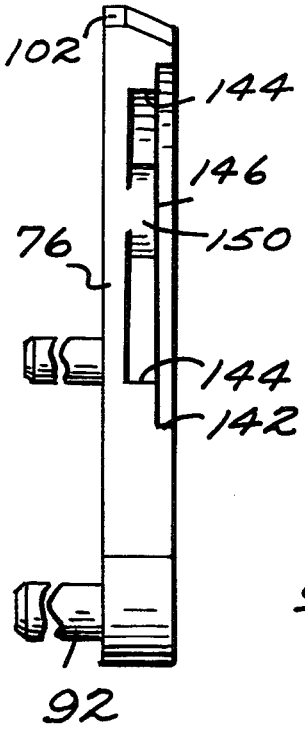
FIG. 10 is a left-hand end view of the hand shown in FIG. 9.
Figure 9:
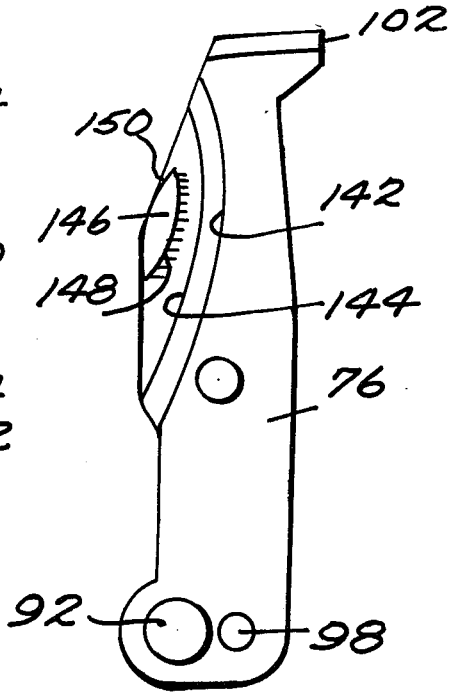
FIG. 9 is a side elevational view of the hand showing the modifications made in accordance with the principles of the present invention.
Figure 11:
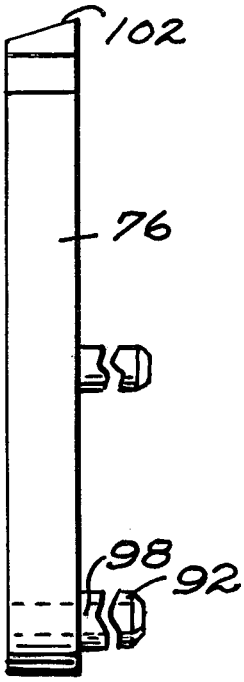
FIG. 11 is a right-hand end view of the hand shown in FIG. 9.

As best shown in FIGS. 9 through 11, the modifications to the hand 76 include the formation of a recess 142 within the exposed surface of the hand 76 when the side plate 138 is removed. Formed within the recess 142 is a cam track 144. As best shown in FIG. 9, the cam track 144 is of generally shallow arcuate configuration, with opposite ends thereof opening to the rear surface of the hand 76 so as to define a land portion 146 which has a forwardly facing convexly arcuate cam surface 148 and a rearwardly facing convexly arcuate cam surface 150.

Figure 7:
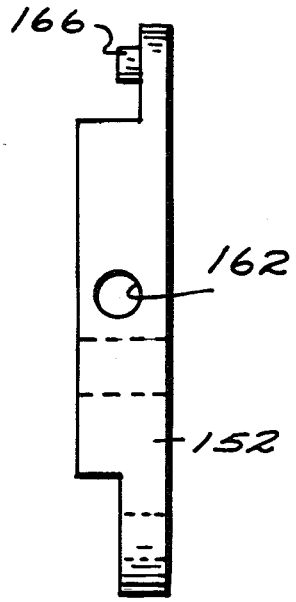
FIG. 7 is a left-hand end view of the lever shown in FIG. 6.
Figure 6:
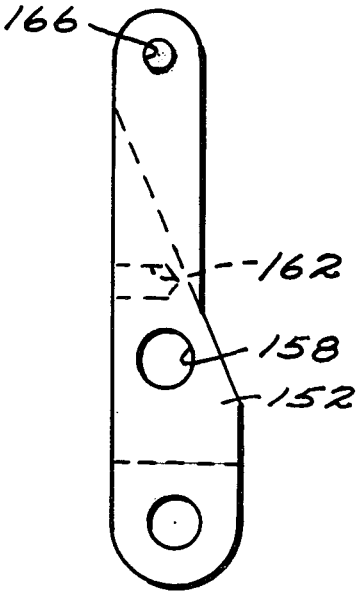
FIG. 6 is a side elevational view of the lever shown in FIG. 5 viewing the same from the opposite surface shown in FIG. 5.
Figure 8:
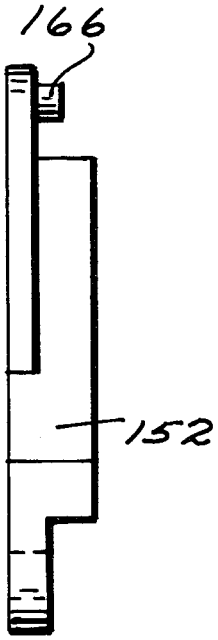
FIG. 8 is a right-hand end view of the lever shown in FIG. 6.

Referring now more particularly to FIGS. 6 through 8, the added component is shown therein in the form of a lever 152. Lever 152 is adapted to be mounted on the side plate 138 for limited pivotal movement, as by a pivot pin 154. FIG. 4 illustrates the interior configuration of the side plate 138 of the conventional gun 10 shown in FIG. 2. FIG. 5 shows the modification of the plate with the lever 152 mounted therein by the pin 154. It will be noted that in order to accommodate the mounting of the lever 152 in the side plate 138, a lever receiving recess 156 is milled within the interior surface of the side plate 138.

A central portion of the lever 152 is formed with a throughbore 158 which has its axis parallel with the axis of the pin 154. The interior periphery of the bore 158 serves as opposed stop surfaces in cooperation with a small diameter pin 160 fixed within the side plate 138 and extending within the bore 158.

A blind bore 162 is formed in the rear surface of the lever 152 at a position spaced slightly above the bore 158. The axis of the blind bore 162 extends at right angles with respect to the axis of the bore 158. The blind bore 162 opens rearwardly to receive the forward end of a coil spring 164, the rearward end of which engages the adjacent wall of the recess 156. The spring 164 thus serves to resiliently bias the lever 152 into a forward position which is limited by the engagement of the stop pin 160 with the rearward peripheral wall portion of the bore 158.

The end portion of the lever 152 opposite from the pin 154 is of reduced width and thickness and the outer extremity thereof is formed with a cam follower 166. The cam follower 166 is in the form of a pin mounted in the end of the lever 152 with its axis disposed parallel with the axis of the pin 154. The cam follower pin extends in a direction inwardly with respect to the lever and is adapted to engage cam surfaces 148 and 150 of the modified hand 76. The periphery of the projecting portion of the cam follower pin 166 may be changed in contour to insure that its engagement with the cam surfaces 148 and 150 will have the effect of guiding the hand end 102 along the aforesaid different path during the movement of the hand with the trigger from its ending position into its starting position.

Figure 14:
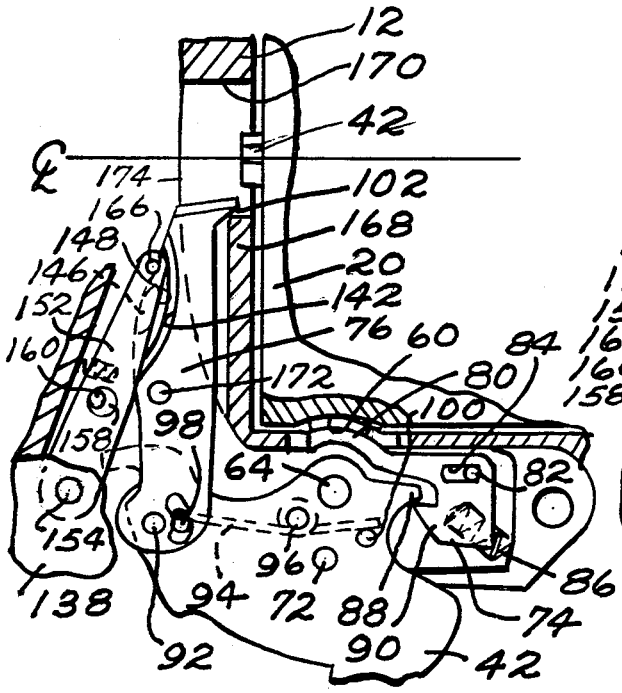
FIGS. 14 through 17 are fragmentary side elevational views partly broken away illustrating the cooperation between the modified hand and lever of the present invention in various stages during the firing stroke of the trigger and the return stroke of the trigger.

FIGS. 14 through 17 illustrate the cooperation between the cam follower 166 of the lever 152 and the cam surface 148 and 150 of the hand 76 during a cycle of movement of the hand from its starting position to its ending position and back into its starting position. The position of the parts in FIG. 14 correspond generally to the position of the parts shown in FIG. 12. It will be noted that the trigger 42 is in its forward position. The cylinder lock 74 is in its cylinder locking position and disposed in operative engagement with the trigger by virtue of the overlapping relationship between latch portions 88 and 90. The hand 76 is in its starting position with the end 102 thereof being held somewhat away from a position of engagement beneath the next ratchet tooth 42 by virtue of an abutment edge 168 which is disposed in a position to engage beneath the hand end 102. The frame 12 of the gun is formed with a slot 170 which serves to laterally stabilize the hand 76 during its movement from its starting position, as shown in FIG. 14, and its ending position. The lever 152 is disposed in its limiting position under the yieldable urging of spring 164 by virtue of the engagement of the stop pin 160 with the wall opening 158. The cam follower pin 166 mounted on the upper free end of the lever 152 is disposed a position above the cam surface 150 formed on the hand 76.

Figure 15:
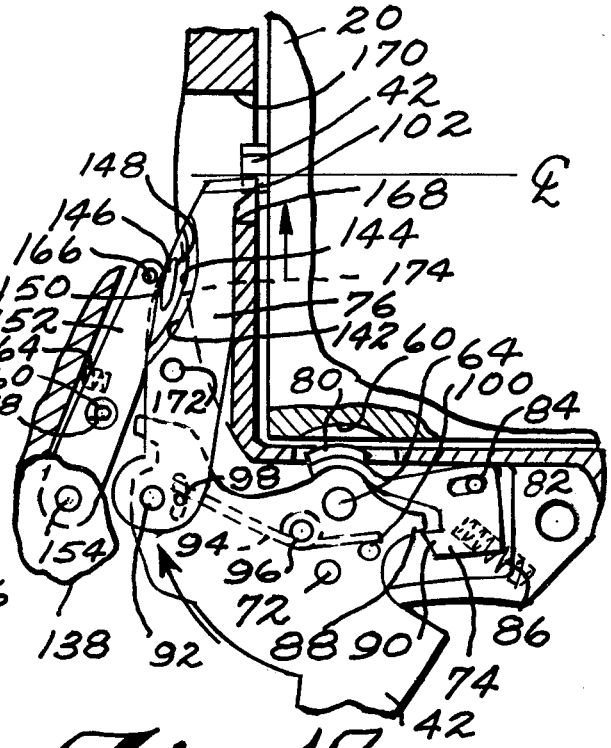

FIG. 15 shows the position of the parts after the trigger has been moved a short distance rearwardly from its forward position. In this position latch portion 88 of the trigger has engaged latch portion 90 of the cylinder stop 74 so as to move the locking portion 80 thereof into its cylinder releasing position. The end 102 of the hand 70 has been moved inwardly and upwardly into a position of engagement with the ratchet tooth 42. It will be noted that the cam follower 166 has engaged the cam surface 150, resulting in a slight counter-clockwise pivotal movement of the lever 152, as viewed in FIG. 15, about the pivot pin 154 against the action of spring 164.

As the trigger continues to move in a rearward direction from the position shown in FIG. 15, the hand end 102 moves upwardly in engagement with the ratchet tooth 42 to commence the rotational movement of the cylinder 20 toward its next indexed position. Thereafter the trigger latch portion 88 disengages from the cylinder stop latch portion 90, allowing spring 86 to resiliently bias the cylinder stop 74 in a clockwise direction, as viewed in FIG. 15. The locking portion 80 of the cylinder stop moves into engagement with the periphery of the cylinder 20 in a position to be biased into the next cylinder recess 60.

Figure 16:
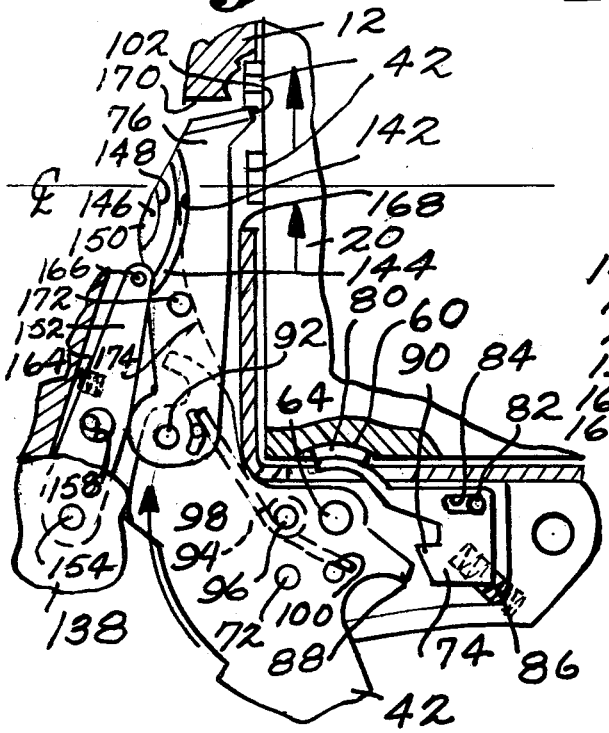

FIG. 16 illustrates the position of the parts when the trigger has been moved rearwardly through the cocking segment of its firing stroke. The position of the parts shown in FIG. 16 is similar to the position of the parts shown in FIG. 13. The end 102 of the hand 76 has, by virtue of its engagement with the ratchet tooth 42, moved the cylinder 20 into its next position, and the locking portion 80 of the cylinder lock 74 has moved into its cylinder locking position within the next cylinder recess 60. The lever 52 is disposed in its forward limiting position under the urging of spring 164 and the cam follower pin 166 thereof is disposed in a position within the cam track 144 below the cam surface 148. The end 102 of the hand 76 has been moved rearwardly against the action of spring 94 by virtue of the engagement of a pin 172 fixed to the hand and extending laterally therefrom with an associated rearward surface 174 of the frame 112 defining the slot 170.

Figure 17:
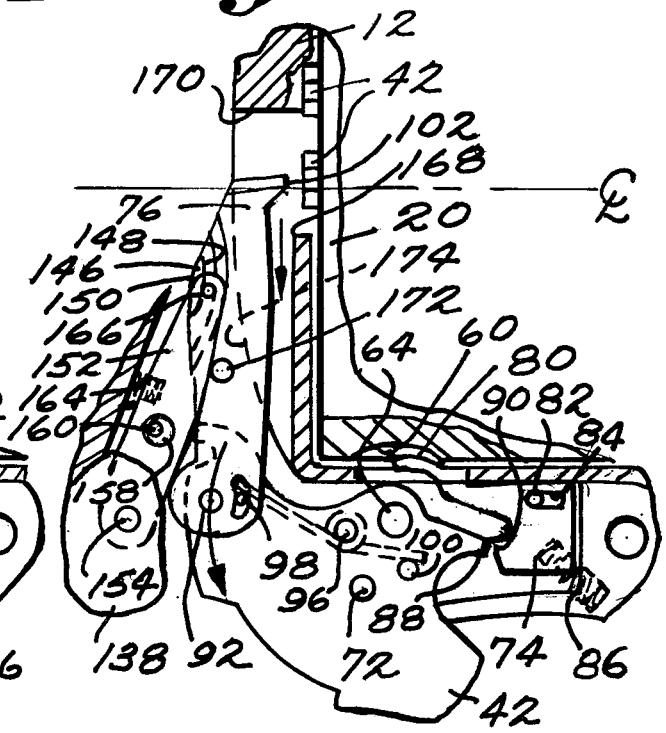

FIG. 17 shows the position of the parts during the forward movement of the trigger through the second segment of its return stroke. In the position shown, the hand 76 has been moved downwardly sufficient to cause the cam surface 148 to engage the cam follower pin 166. The engagement of the cam surface 148 with the follower pin 166 is in a direction tending to move the lever 152 in a clockwise direction, as viewed in FIG. 17. However, such movement is prevented by the engagement of the stop pin 160 with the wall of the opening 158. Consequently, as the hand 76 is moved downwardly with the trigger 42, a counter-clockwise movement of the hand about its pivot pin 92 is imparted to the hand by virtue of engagement of cam surface 148 with the cam follower pin 166.

In this way, the end 102 of the hand is moved through a different path of movement from its ending position into its starting position than the path which it followed in moving from its starting position into its ending position. As shown in FIG. 17, this different path is displaced rearwardly so that the hand end 102 is disposed in a position rearwardly of the position it assumes to engage the ratchet tooth during its upward movement.

FIG. 17 also illustrates the trigger latch portion 88 in a position with respect to the cylinder latch portion 90 such that it has moved the cylinder lock 74 forwardly against the bias spring 86. This forward movement is accommodated by virtue of the slot 84 in the cylinder lock, the arrangement permitting the lock portion 80 of the cylinder lock to be retained within the recess 60. As the movement of the trigger 62 is continued forwardly from the position shown in FIG. 17, the latch portion 88 of the trigger moves upwardly past the latch portion 90 of the cylinder lock to effect engagement therebetween. Spring 86 serves to bias the cylinder lock 74 rearwardly to effect the engagement and slot 84 accommodates such movement.

The shape and position of the cam surface 148 with respect to the cam follower pin 166 is such that the two remain in engagement with one another during the forward movement of the trigger 62 forwardly beyond the position shown in FIG. 17 to an extent sufficient to assure interengagement of the latch portions 88 and 90. Thereafter, the cam surface 148 passes downwardly out of engagement with the cam follower pin 166. As soon as the cam follower pin 166 disengages from the cam surface 148, the hand 76 is free to move in a clockwise direction, as viewed in FIG. 17, about its pivot pin 92, under the urging of spring 94. In this way, the end 102 of the hand 76 is allowed to move into a position to engage the next ratchet tooth only after the trigger 62 has been engaged with the cylinder lock 74. Thus, if the movement of the trigger 62 is reversed from a forward movement to a rearward movement at any position within the second segment of the return stroke of the trigger up to the point of interengagement between latch portions 88 and 90, the cam follower pin 166 will be in engagement with the cam surface 148 and therefore the hand end 102 will be returned to its ending position, as shown in FIG. 16, along the different path out of engagement with the ratchet tooth 42. It is only after trigger 62 has been engaged with the cylinder lock 74 that the hand end 102 is allowed to travel along its ratchet tooth engaging path.

It can thus be seen that the operation of lever 152 and the cooperation of its cam follower 166 with the cam surfaces 148 and 150 provided on the modified hand 76 insure against the type of lock out which is possible with conventional hand guns including the conventional hand gun shown. Instead of lock out, the improvement of the present invention permits movement of the trigger 62 into its rearward position at all times without lock out, thus enabling the user to instinctively release the trigger for repeated double action firing. Whether or not the hammer will be moved from its rearward position into its cocked position is dependent upon how far the trigger is allowed to be moved toward its forward position before its movement is reversed. It is of importance to note that the lever 152 and the cooperation of its cam follower pin 166 with the cam surfaces provided by the modified hand has virtually no effect whatsoever on the normal operation of the gun during double action firing or single action firing, and thus the feel of the gun during firing is virtually uneffected. It is only during the return stroke of the trigger that the normal operation is at all modified.

The present invention is applicable, as far as applicants are aware, to all hand guns of the revolver type currently being manufactured. Applicants are aware of only one hand gun of the revolver type which has been produced and used in any quantity which does not inherently present the lock up problem solved by the present invention. Reference is here made to the British Webley Mark IV Pistol which does not embody a cylinder stop of the type herein described, but rather utilizes a fixed stop on the trigger and a separate movable trigger catch, the cylinder having a double row of recesses for cooperating with the cylinder stop fixed to the trigger and the trigger catch. This arrangement is peculiar to the British Webley.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a hand gun including a frame having a hand grip, a barrel extending outwardly from said frame and having an axis, a cylinder mounted on said frame for indexed step-by-step rotational movement about an axis parallel to the axis of said barrel, said cylinder having a series of cartridge chambers disposed in annularly spaced relation about the axis of said cylinder in positions to be successively axially aligned with said barrel in successive indexed step-by-step rotational movements thereof, a hammer pivotally mounted on said frame for movement between a cocked position and a firing position toward which it is spring urged, a cylinder stop mounted on said frame for movement between a cylinder locking position toward which said cylinder stop is spring urged and a cylinder releasing position, said cylinder having a plurality of indexing ratchet teeth thereon, a hand having an end spring urged to engage successive ratchet teeth, a trigger pivotally mounted on said frame for manual movement from a forward position into a rearward position through a firing stroke including a relatively large cocking segment and a relatively small firing segment and for spring urged movement from said rearward position into said forward position through a return stroke including a first segment corresponding to said firing segment and a second segment corresponding to said cocking segment, said trigger having (1) an engagable and disengagable connection with said cylinder stop, (2) a pivotal connection with said hand and (3) an engagable and releasable connection with said hammer such that when (A) said trigger is moved through the cocking segment of its firing stroke (1) said cylinder stop is engagingly moved into its cylinder releasing position and then disengaged for spring urged movement into its cylinder locking position in response to the completion of the next indexed movement of said cylinder (2) said hand is moved to engage the end thereof with a ratchet tooth after said cylinder stop has been moved into the cylinder releasing position so as to effect movement of said cylinder through its next indexed movement and (3) said hammer is moved into its cocked position and (B) when said trigger is subsequently moved through the firing segment of its firing stroke said hammer is released for spring urged movement from its cocked position into its firing position to discharge a cartridge in the cartridge chamber aligned with said barrel, said hammer having a thumb engaging spur by which said hammer can be (A) manually moved into its cocked position so as to cause the trigger to move therewith through the cocking segment of its firing stroke and (B) manually moved back into a battery position adjacent its firing position so as to allow said trigger to be spring urged for movement through the second segment of the return stroke which if manually controlled until after the hammer has been returned under manual control to its battery position results in a manually controlled movement of the trigger through the second segment of its return stroke so as to cause the following three functions to occur (1) movement of said hand into a position to engage the end thereof with the next ratchet tooth, (2) engagement of said trigger with said cylinder stop while the latter is in its locked position and (3) engagement of said trigger with said hammer, the improvement which comprises means for insuring that during a manually controlled movement of the trigger through the second segment of the return stroke following a manual hammer movement back into its battery position function (1) will occur after function (2) so that said trigger can be manually moved into its rearward position from any position within the manually controlled second segment of the return stroke of said trigger thus preventing the trigger from being locked against such movement as would be the case when function (1) occurs before function (2) and the manual movement of the trigger toward its rearward position is commenced after function (1) has been accomplished and before function (2) has been accomplished.

2. The improvement as defined in claim 1 wherein the end of said hand is moved by said trigger from a starting position along a ratchet tooth engaging path into an ending position during the cocking stroke of said trigger, said insuring means comprising means for causing the end of said hand to move from said ending position along a ratchet tooth avoiding path into said starting position during the second segment of the return stroke of said trigger so that said hand end will follow said ratchet tooth avoiding path when said trigger is manually moved into its rearward position from any position within the manually controlled second segment of the return stroke of said trigger before said function (1) is performed.

3. The improvement as defined in claim 2 wherein said path causing means comprises means defining a cam track and a cam track follower mounted for relative movement along said cam track.

4. The improvement as defined in claim 3 wherein said cam track defining means comprises a groove formed in said hand defining said cam track, said cam follower being mounted on a lever mounted on said frame for limited pivotal movement.

5. The improvement as defined in claim 4 wherein said lever is mounted alongside of said hand in a position such that said hand is between said lever and said cylinder ratchet teeth.

6. The improvement as defined in claim 5 wherein said lever has spring means operatively connected herewith for resiliently urging said lever in a direction toward said hand.

* * * * *